US005875959A

United States Patent [19]

Weiteder et al.

[11] Patent Number: 5,875,959

[45] Date of Patent: Mar. 2, 1999

[54] CUBOID FLAT GABLE PACKAGE

[75] Inventors: Hans Josef Weiteder, Herzogenrath; Holger Schmidt, Baesweiler, both of Germany

[73] Assignee: PKL Verpackungssysteme GmbH, Linnich, Germany

[21] Appl. No.: 716,437

[22] PCT Filed: Mar. 21, 1995

[86] PCT No.: PCT/EP95/01044

§ 371 Date: Nov. 5, 1996

§ 102(e) Date: Nov. 5, 1996

[87] PCT Pub. No.: WO95/25670

PCT Pub. Date: Sep. 28, 1995

[30] Foreign Application Priority Data

Mar. 23, 1994 [DE] Germany ..... 44 09 947.9

[51] Int. Cl.[6] ..... B65D 51/22

[52] U.S. Cl. ..... 229/125.15; 229/125.09; 229/204; 493/87; 493/102; 493/114

[58] Field of Search ..... 229/125.09, 125.14, 229/125.15, 204; 220/267, 277; 493/87, 102, 114

[56] References Cited

U.S. PATENT DOCUMENTS

| | | | |
|---|---|---|---|
| 4,852,764 | 8/1989 | Store | 220/315 |
| 4,915,290 | 4/1990 | Robichaud et al. | 229/125.08 |
| 4,930,683 | 6/1990 | Farber | 229/204 |
| 4,944,408 | 7/1990 | Rausing | 220/277 |
| 5,101,999 | 4/1992 | Robichaud et al. | 229/125.09 |
| 5,364,019 | 11/1994 | Bjorck et al. | 229/125.09 |

FOREIGN PATENT DOCUMENTS

| | | | |
|---|---|---|---|
| 363528 | 4/1990 | European Pat. Off. | 220/277 |
| 3808303 A1 | 3/1988 | Germany . | |
| 2241225 | 8/1991 | United Kingdom . | |
| 2267896 | 6/1992 | United Kingdom . | |
| PCT/US91/08519 | 11/1991 | WIPO . | |

*Primary Examiner*—Gary E. Elkins
*Attorney, Agent, or Firm*—Standley & Gilcrest

[57] ABSTRACT

The specification represents and describes a cuboid flat gable package made from a multi-layer composite, with the composite having at least one carrier layer made from paper or cardboard, a coupling layer, a barrier layer and a double-sided plastic coating made from polyethylene (PE), with an opening area provided in the package gable which forms the pour opening after the severing, with a pouring element provided with a reclosable closing lid whose flange encompassing the opening area is rigidly connected to the package surface, with the closing lid simultaneously representing the opening mechanism. A reliable connection of pouring element and package gable is ensured in such a way that the opening area is provided with a weakening for support, that the pouring element is arranged on the side of the package surface on which the gable seam is folded and that the part of the flange of the pouring element facing the gable seam reaches approximately up to the gable seam and up to the folding edge of the package tab and is fixed between package surface and folded gable seam. Furthermore, a process to produce such a flat gable package is described.

17 Claims, 3 Drawing Sheets

Fig.2
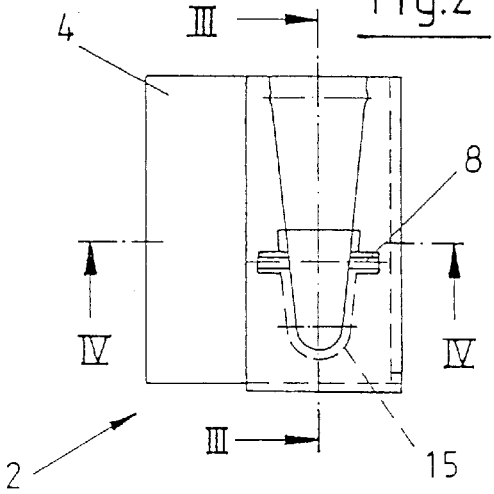
Fig.3
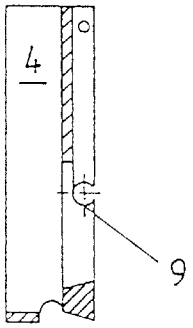
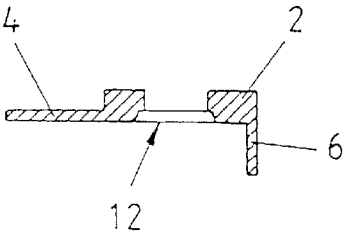
Fig.4
Fig.5
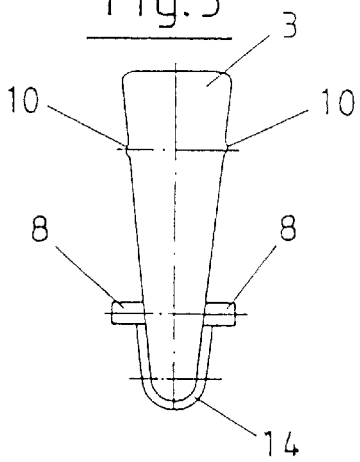
Fig.6
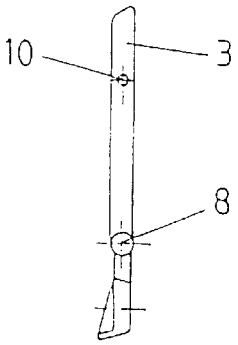

CUBOID FLAT GABLE PACKAGE

The invention relates to a cuboid flat gable package, in particular a tab package with central or corner seam, with the composite having at least one carrier layer made from paper or cardboard, a coupling layer, a barrier layer, preferably made from aluminium, and a double-sided plastic coating made from polyethylene (PE), with an opening area provided in the package gable which forms the pour opening after the severing, with a pouring element provided with a reclosable closing lid whose flange encompassing the opening area is rigidly connected to the package surface, with the closing lid simultaneously representing the opening means and with the opening area having a weakening to support the opening process, as well as a method to produce such a cuboid flat gable package.

Cuboid flat gable composite packages are known in numerous arrangements. They are used predominantly in the field of liquid packages in connection with cold, cold-sterile, hot and aseptic fillings. These packages can usually not be closed any more once they are opened. It has therefore already been proposed in connection with flat gable composite packages of the kind mentioned above to arrange a pouring element in the package gable which is equipped with a respective closing lid (DE 38 08 303 A2). A circular severing line to weaken the gable material is provided in the zone of the cardboard layer and the outer PE layer, into which a respective tubus, which is connected with the closing lid in one piece and corresponds to the shape of the circular severing line, is pressed into the package material in order to open the package. For the purpose of easier severing of the weakened severing line, the lower edge of the tube is provided with suitable mechanical opening means such as blades or the like.

The aforementioned flat gable composite package can be improved in respect of several items. It is clear that for the purpose of storage and transportation it must be ensured that the tube connected with the closing lid must not penetrate the material prematurely, i.e. prior to the first use of the package. For this purpose a strap is provided according to the current state of the art for this kind of inventions which fixes at a specific distance the closing lid and the flange of the pouring element which circles the severing line. Only after the removal of the strap is it possible to push the opening tubus into the package composite material by pressing in the closing lid. This leads to the consequence that a certain minimum height of the known pouring element is mandatorily required. This is a disadvantage owing to the stackability required for flat gable composite packages.

Other known flat gable packages (EP 0 238 947 B1) provide that the pour opening is opened up by pulling off a strap which covers the opening area. Although this leads to a particularly flat overall height, this proposed solution is not capable of ensuring the tight reclosability of the packages. Moreover, this solution requires the severing and immediate resealing of the liquid sealing layer and the barrier layer, which leads to risks concerning tightness and sterility.

Although the requirement concerning the reclosability and tightness is sufficiently met by the pouring elements applied on the package gable, the resultant which usually projects outwardly on the joint in lever mechanisms leads to tearing off the pour spout in the known embodiments owing to the weak layer adherence of the cardboard layer or the cardboard PE layers. Moreover, the tearing off of pouring elements frequently occurs during the transportation and stacking of such flat gable packages, particularly as a result of the overall height of the pouring element. Such a package is no longer usable and is no longer accepted by retailers and consumers.

Starting out from this, the present invention is based on the object of providing and further developing a cuboid flat gable composite package of the type mentioned above and a process for its production, so that a reliable connection of pouring element and package gable is securely ensured. In addition, it is desired that the overall height of the pouring element used is reduced.

With respect to the flat gable composite package, the solution to this object consists of arranging the pouring element on the side of the package surface where the gable seam is folded and that the part of the flange of the pouring element facing the gable seam reaches approximately up to the gable seam and up to the bending edge of the package tab and is fixed between package surface and folded gable seam. As a result of the secure fixing of the flange of the pouring element between gable seam and the upper side of the package, the tearing off of the pouring element during the opening and handling is reliably prevented.

With respect to the production process of such a flat gable composite package, the object is achieved by the following steps:

- Producing the opening area in the carrier layer in the zone of the future pouring opening;
- corrugating the multi-layer composite;
- prefolding the package blank;
- sealing the longitudinal seam into a tube-like package envelope;
- folding and sealing of the package floor;
- filling the package;
- folding and sealing the upper gable seam;
- application of the pouring element provided with the closing lid on the opening area with vertically projecting gable seam;
- folding the gable seam;
- folding and sealing on the package tabs.

A further doctrine of the invention provides that the part of the flange of the pouring element which is averted from the gable seam is arranged beyond the package edge in one suffient piece with a back square which partly encompasses the side wall of the package and the face wall of the package. The back square is securely fixed by the package tabs after the sealing on of the package tabs. In such an embodiment of the pouring element the glueing on occurs on three different package sides. In addition to the further improved adherence of pouring element and package surface (caused by the back square) it is also ensured reliably that the pouring element cannot be displaced with respect to the opening area during the application. It is understood that pouring elements of different sizes have to be used for the different package sizes, in any case concerning the size of flange and back square. As a result of the fact that the application of a pouring element provided with a back square occurs while the gable seam still projects perpendicularly and the package tabs project horizontally, it is necessary to provide a recess in the zone of the respective package tab between the face-sided part of the back square and the actual pouring element. This recess is favourably arranged in a slot-like manner, with the slot width only being slightly larger than the thickness of the package tab. In this way the sealing on of the tabs on the face side of the package fixedly seals a part of the back square between package tab and the face wall of the package, and the connection between pouring element and package is increased further.

To weaken the opening area in the zone of the future pouring hole it is possible, on the one hand, to omit the carrier layer entirely in the zone of the opening area and that after punching out or cutting out the opening area in this zone only the PE-layers and the barrier layer have to be destroyed. It is also possible that for weaking purposes the carrier layer and, optionally, the coupling layer in the zone of the opening area are provided with a severing line, e.g. a semi-circular one. This severing line can also be punched out, but preferably such a severing line is produced by means of a laser beam cut.

In accordance with a Further doctrine of the invention, the pouring element is provided with a pass-through opening which in its size and shape corresponds to the opening area provided on the package gable. Furthermore, the closing lid is arranged as an opening lever in accordance with the invention, which lever is connected with the pouring element in a hinged manner so that during its actuation the package is opened, e.g. semi-circularly, in the zone of the opening area. For this purpose the closing lid is provided in accordance with a further doctrine of the invention with two laterally projecting journals for pin-jointed bearing which engage in respective recesses in the pouring element. The recesses receiving the journals are favourably arranged laterally above the pass-through opening in the pouring element. The closing lid arranged as an opening lever and the pouring element are produced in two parts and the recesses in the pouring elment are arranged in such a way that they allow a subsequent clamping tight of the journals.

Prior to the application of the pouring element provided with the closing lid it is therefore necessary to join both parts.

It has proved particularly favourable that the journals divide the opening lever at a ratio of 1:5 to 1:3 (pressing-in lever handle lever). In this way a relatively simple opening of the package is ensured as a result of the lever action. To ensure that the closing lid can be closed tightly with the pouring element to achieve the desired re-closability, a further doctrine of the invention provides that the closing lid and/or the pouring element are provided with means for snap-catching the closing lid in the closing position.

In a further embodiment of the invention it is provided that the pouring element is provided towards the face wall of the package with a pouring groove. This ensures that after the pouring, as a result of the sharp dripping edge, liquid cannot run down along the face side of the package and any remaining residual liquid flows back into the interior of the package through the pouring groove. The danger of the closing lid sticking tight is thus minimized.

The invention is now explained in closer detail by reference to the enclosed drawing showing merely an embodiment, wherein:

FIG. 2 shows the pouring element of the flat gable package in accordance with the invention in a top view;

FIG. 3 shows a section through the pouring element along the line III—III from FIG. 2;

FIG. 4 shows a section through the pouring element along the line IV—IV :from FIG. 2;

FIG. 5 shows the closing lid provided for the pouring element in accordance with the invention in a top view;

FIG. 6 shows the closing lid from FIG. 5 in a side view in the direction of arrow VI;

Figure 1:
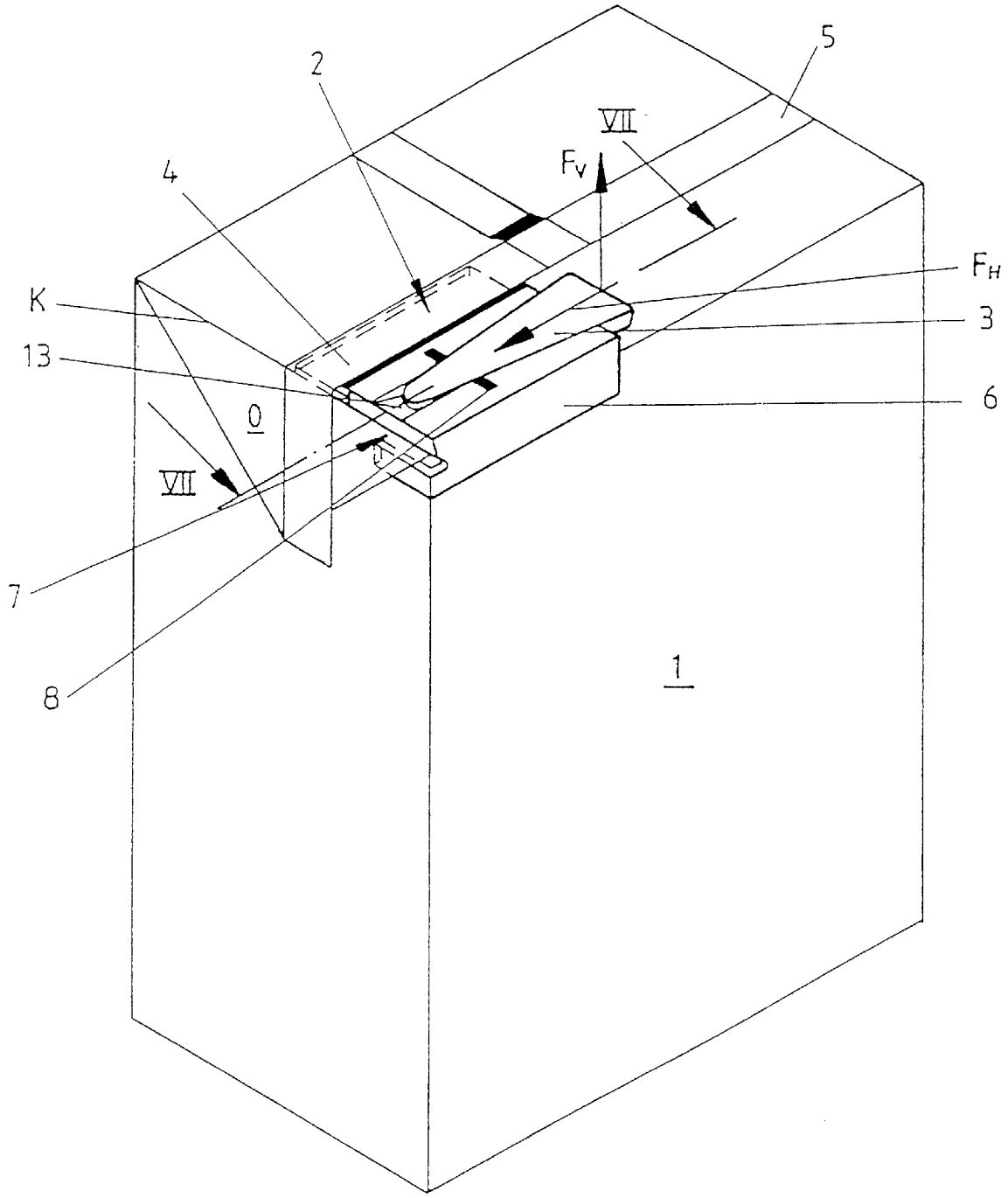
FIG. 1 shows a flat gable package in accordance with the invention in a perspective view.

FIG. 1 respresents a cuboid flat gable package in accordance with the invention in its entirety in a perspective view. It represents a pouring element 2 with a closing lid 3 which simultaneously represents the opening means of the flat gable package 1. A flange 4 of the pouring element 2, which encompasses the opening area (not shown) on the upper side of the package, is rigidly attached to the package surface.

FIG. 1 further shows that the pouring element 2 is arranged on the side of the package surface on which the gable seam 5 of the flat gable package 1 is folded and that the part of the flange 4 of the pouring element 2 facing the gable seam 5 reaches approximately up to the gable seam 5 and up to the folding edge K of the package tab O and is fixed between package surface and folded gable seam 5. In this way the pouring element 2 is fixed over its entire length and determined by the face-sided sealing of the package tabs (not designated in closer detail) . The force occurring during the opening of the package by means of closing lid 3 as opening means can be broken down into a vertical component $F_v$ and into a horizontal component $F_h$. It is clearly to be seen that by the special arrangement of flange 4 of the pouring element 2 any tearing off of the pouring element 2 is prevented reliably, because the part of the flange 4 which reaches up to the gable seam 5 is overlapped by the folded gable seam. This fact and the sealing on of the entire flange 4 reliably counteract the vertical component $F_v$ of the opening force. The horizontal component $F_h$ is absorbed on the one hand by the sealing on of flange 4 and on the other hand because the flange 4 in the zone of gable seam 5 reaches up to the folding edge K of the package tab O and is fixed by the folded gable seam 5 and the sealed package tab O.

For further increasing the connection of the pouring element 2 and the flat gable package 1 it is provided in accordance with the invention that the part of the flange 4 of the pouring element 2 which is averted from the gable seam 5 reaches over the edge of the package and is arranged in one piece with a back square 6 partly encompassing the side wall and face wall of the package. It can be seen that the face-sided part of the back square 6 is provided with a recess 7 through which the package tab (not determined in closer detail) extends. As a result of the presented and thus preferable embodiment, the pouring element 2 is joined even more rigidly with the package surface. The part of the back square o which projects on the face wall of the package is clamped between the package face wall and the tab O which is folded down, so that both components $F_v$ and $F_h$ of the opening force can be absorbed even better. Any tearing off of the pouring element 2 is thus reliably excluded.

The arrangement of such a possible embodiment of the pouring element 2 with the respective closing lid 3 pursuant to the invention is shown in FIGS. 2 to 6. The closing lid 3 is thus hinged with the pouring element 2 in such a way that on its actuation the flat gable package 1 is opened in the zone of the opening area, as will be explained below in closer detail by reference to FIGS. 7A to 7C For the hinged bearing in the pouring element 2, the closing lid 2 is provided with two laterally projecting journals 8 which engage in the recesses 9 in the pouring element 2. In the represented and thus preferable embodiment of the pouring element 2 the recesses 9 receiving the journals 8 are arranged above the opening area at the side of the pass-through opening 12.

Figure 7A:
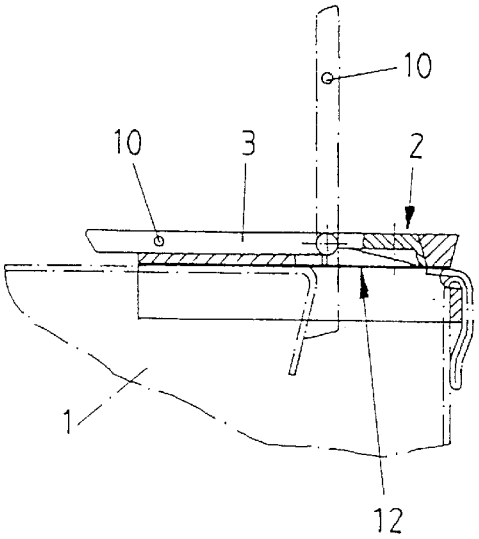
FIG. 7A shows a first embodiment of the pouring element applied on the flat gable package in a cross section along the line VII—VII from FIG. 1.
Figure 7B:
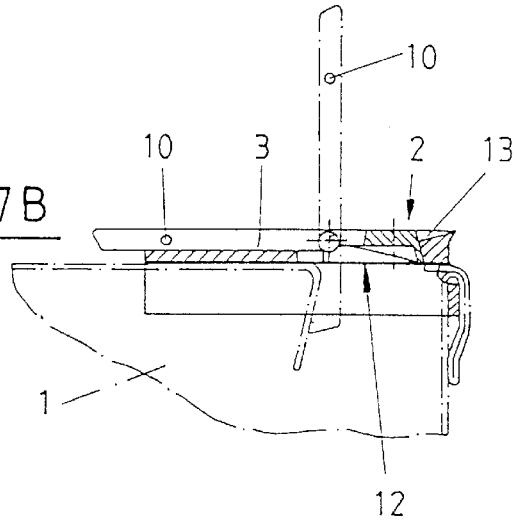
FIG. 7B shows a second embodiment of the pouring element applied on the flat gable package in a cross section along the line VII—VII from FIG. 1.
Figure 7C:
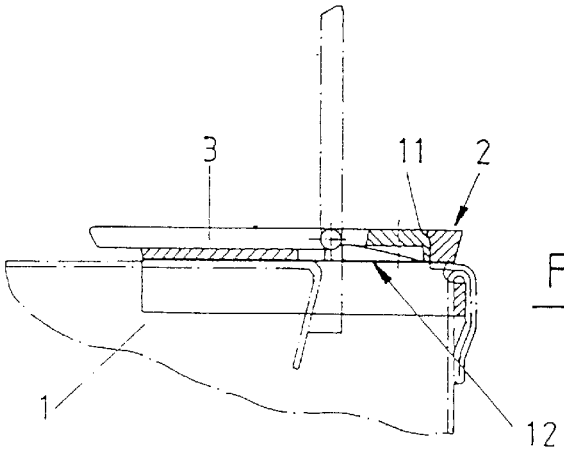
FIG. 7C shows a further embodiment of the pouring element applied on the flat gable package in a cross section along the line VII—VII from FIG. 1.

FIGS. 7A to 7C now show several embodiments of the pouring element 2 in accordance with the invention, applied on a flat gable package indicated in dot-dash lines. It can be seen that the journals 8 divide the closing lid 3, which is arranged as an opening lever, approximately at a ratio of 1:4, with the given ratio representing the relationship between the pressing-in part of the lever and the handle part of the lever. FIGS. 7A to 7C show in a dot-dash line the opening position of the closing lid 3. For secure re-closeability the opening lever 3 as indicated in FIGS. 7A and 7B is provided with two snap-on noses 10 which are disposed at the side in the zone of the handle lever and snap into respective recesses of the pouring element (not disclosed in closer detail). An alternative embodiment is shown in FIG. 7C. The pouring element 2 is provided with a clamping nose 11 which cooperates with a respective recess in the opening lever (not disclosed in closer detail).

The common feature of the embodiments in FIGS. 7A to 7C is that the closing lid 3 presses into the package in the zone of the opening surface (not disclosed in closer detail) and thus forms a pass-through opening 12. FIG. 1 and 7B disclose further that the pouring element 2 is provided with a pouring groove 13 which allows a drip-free pouring of the content of the package.

Moreover, FIGS. 2 and 5 disclose that in the represented and thus preferable embodiment the closing lid 3 is provided with a sealing edge 14 which overlaps the opening area at its forward edge and which rests in a respective recess 15 in the pouring element 2 when the closing lid 3 is closed.

Figure 8A:
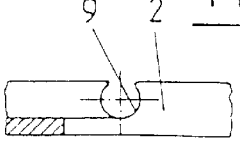
FIGS. 8A and 8B show embodiments of the possible fastening of the closing lid on the pouring element.
Figure 8B:
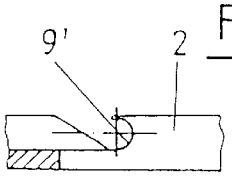

Finally, FIGS. 8A and 8B disclose that different variants are possible for clamping the journal 8 in the pouring element 2. The variant pursuant to FIG. 8A corresponds to the embodiment of recess 9 already shown in FIG. 3. An alternative is shown in FIG. 8B. The snap-on of the closing lid 3 into the pouring element 2 does not occur there vertically to the surface of the pouring element 2, but at an angle of approx. 45°. The advantage of this embodiment can be seen in such a way during the opening movement a better support of the journal 8 in the recess 9' is ensured and an inadvertent "levering out" of the closing lid 3 is reliably prevented.

We claim:

1. A cuboid flat gable package prepared from a composite having at least one carrier layer made from paper or cardboard, a coupling layer, a barrier layer, and a double-sided plastic coating made from polyethylene (PE), with an opening area provided in the package gable which is adapted to be severed to form a pour opening, with a pouring element provided with a reclosable closing lid having a flange encompassing the opening area that is rigidly connected to a package surface, with the closing lid adapted to sever the opening area and with the opening area having a weakening to facilitate opening, characterized in that the pouring element is arranged on a side of a package surface to which a gable seam is folded and a part of the flange of the pouring element facing the gable seam extends approximately to the gable seam and is fixed between the package surface and the folded gable seam.

2. A flat gable package as claimed in claim 1, wherein a part of the flange of the pouring element which is opposite of the gable seam beyond an edge of the package and is arranged in one piece with a back square partly encompassing a side wall and a face wall of the package.

3. A flat gable package as claimed in claim 2, wherein a recess is provided in a zone of a package tab between a face-sided part of the back square and an upper portion of the pouring element.

4. A flat gable package as claimed in claim 3, characterized in that the recess is arranged as a slot-like recess and the width of the slot is only slightly larger than the thickness of the package tab.

5. A flat gable package as claimed in one of the claims 1 to 4, wherein as a weakening the carrier layer and the coupling layer are omitted in a zone of the opening area.

6. A flat gable package as claimed in claim 1, wherein as a weakening the carrier layer and the coupling layer arc provided with a notch in a zone of the opening area.

7. A flat gable package as claimed in claim 5 or 6, wherein the omission of the carrier layer and the coupling layer and/or the notch is produced by means of laser beam cutting.

8. A flat gable package as claimed in claim 1, wherein the pouring element is provided with a pass-through opening which corresponds to the opening area in its size and shape.

9. A flat gable package as claimed in claim 1, wherein the closing lid is arranged as an opening lever which is hinge-jointed in such a way with the pouring element that on its actuation the flat gable package is opened in a zone of the opening area.

10. A flat gable package as claimed in claim 9, wherein the closing lid is provided with two lateral journals for a hinged bearing in the pouring element, said journals adapted to engage into respective recesses in the pouring element.

11. A flat gable package as claimed in claim 10, wherein the recesses receiving the journals are arranged in the pouring element at a side of a pass-through opening of the pouring element.

12. A flat gable package as claimed in claim 10, wherein the recesses in the pouring element allow a subsequent clamping of the journals.

13. A flat gable package as claimed in claim 10, wherein the journals partition the opening lever at a ratio of 1:5 to 1:3.

14. A flat gable package as claimed in claim 1, wherein the closing lid and/or the pouring element are provided with means for snap-locking the closing lid in a closed position.

15. A flat gable package as claimed in claim 1, wherein the pouring element is provided with a pouring groove toward a face wall of the package.

16. A process for producing a flat gable package, comprising:

producing the weakening in the carrier layer in the zone of the future pouring opening;

prefolding the package blank;

sealing the longitudinal seam into a tube-like package envelope;

folding and sealing of the package floor;

filling the package;

folding and sealing the upper gable seam;

application of the pouring element provided with the closing lid on the opening area with vertically projecting gable seam;

folding the gable seam onto a portion of the pouring element; and folding and sealing on the package tabs.

17. A process as claimed in claim 16, characterized in that the application of the pouring element occurs by means of fusion adhesive.

* * * * *

UNITED STATES PATENT AND TRADEMARK OFFICE

CERTIFICATE OF CORRECTION

PATENT NO. : 5,875,959

DATED : March 2, 1999

INVENTOR(S) : Weiteder, et al.

It is certified that error appears in the above-indentified patent and that said Letters Patent is hereby corrected as shown below:

Column 1, line 24, delete "A2" and insert - -A1- -.

Column 3, line 9, delete "Further" and insert - -further- -;

line 32, after "lever", first occurrence, insert - - : - -.

Column 4, line 50, after "square" delete "o" and insert - -6- -.

Column 6, claim 6, line 11, delete "arc" and insert - -are- -.

Signed and Sealed this

Sixteenth Day of November, 1999

*Attest:*

Q. TODD DICKINSON

*Attesting Officer*

*Acting Commissioner of Patents and Trademarks*